US005445761A

United States Patent [19]

Shah et al.

[11] Patent Number: 5,445,761

[45] Date of Patent: Aug. 29, 1995

[54] PERCARBONATE BASED CLEANER FOR COSMETIC AND PHARMACEUTICAL MANUFACTURING FACILITIES

[75] Inventors: Sadiq Shah, St. Louis; Fred Kirchner, St. Charles, both of Mo.

[73] Assignee: E.R. Squibb and Sons, Inc., Princeton, N.J.

[21] Appl. No.: 126,937

[22] Filed: Sep. 24, 1993

[51] Int. Cl.[6] ..... C11D 3/40

[52] U.S. Cl. ..... 252/94; 252/95; 252/99; 252/102

[58] Field of Search ..... 252/94, 95, 99, 102

[56] References Cited

U.S. PATENT DOCUMENTS 5,030,377 7/1991 Sone et al. ..... 252/174.17

5,089,162 2/1992 Rapisarda et al. ..... 252/102

*Primary Examiner*—Richard L. Raymond

*Attorney, Agent, or Firm*—Theodore R. Furman, Jr.

[57] ABSTRACT

The present invention claims and describes an environmentally sound percarbonate based cleaner for removing cosmetic and pharmaceutical soils from pharmaceutical or cosmetic manufacturing surfaces. The invention includes a combination of a percarbonate; an ethylene oxide/propylene oxide block copolymer surfactant; and a bicarbonate salt. The invention is useful for removing hard-to-remove soils from a pharmaceutical or cosmetic manufacturing surface.

28 Claims, No Drawings

PERCARBONATE BASED CLEANER FOR COSMETIC AND PHARMACEUTICAL MANUFACTURING FACILITIES

BACKGROUND OF THE INVENTION

The present invention relates to a percarbonate based cleaner for cosmetic and pharmaceutical manufacturing facilities.

Most of the soils produced in the cosmetic industry are difficult to remove from manufacturing surfaces. In general, the products used to clean or remove manufacturing soils utilize organic solvents. It is known that organic solvents may be troublesome as organic pollutants.

There is a need, therefore, for a commercial product which is able to clean and remove soils relatively easily without utilizing organic solvents. There is also a need to remove waxy pharmaceutical and cosmetic soils which are difficult to remove by conventional means. The present invention overcomes the disadvantages inherent in the use and application of products based on organic solvents by utilizing the cleaning strength of a peroxide based compound.

Cleaning or detergent compositions utilizing the cleaning power of a peroxide based compound have been disclosed in the prior art. Illustrative examples include U.S. Pat. Nos. 5,030,377 and 5,089,162.

U.S. Pat. No. 5,030,377 discloses automatic dishwasher detergent compositions comprising: (a) at least one surfactant; and (b) at least one starch debranching enzyme selected from the group consisting of pullulanase, isopullulanase and isoamylase. Optional ingredients include alkaline substances such as bicarbonates (0–90%) and bleaching agents such as Na percarbonate (0–85%). The patent does not teach or suggest any combination of its disclosed ingredients that would work to remove cosmetic and pharmaceutical soils from manufacturing surfaces.

U.S. Pat. No. 5,089,162 also discloses a cleaning composition for use in automatic dishwashers. It discloses a cleaning composition including a percarbonate, a bicarbonate and a nonionic surfactant.

SUMMARY OF THE INVENTION

The present invention relates to a formulation comprising percarbonate wherein the formulation is utilized in cleaning and removing tough cosmetic and pharmaceutical soils. The formulation comprises a percarbonate salt, a bicarbonate salt and an ethylene oxide/propylene oxide block copolymer surfactant. The formulation is particularly useful for cleaning or removing tough cosmetic soils such as lipstick, mascara, and pharmaceutical soils such as drugs, lotions and creams. The claimed formulation enhances the stability of hydrogen peroxide while concurrently enabling an acceptable pH of the discharged water. The combination of oxidizing power of the hydrogen peroxide coupled with the generation of oxygen bubbles produced during the treatment process provides maximal cleaning power.

The present invention is therefore related to an improved manufacturing cleanser that provides maximal cleaning power for cosmetic and pharmaceutical soils while simultaneously providing an environmentally safe product. The claimed formulation advantageously may be used at relatively lower temperatures to remove soils from manufacturing vessels or surfaces. The decomposition products of the claimed formulation include oxygen, water and carbonate salts which are environmentally safe byproducts of the cleansing process.

DETAILED DESCRIPTION OF THE INVENTION

The present invention relates to a cleansing formulation comprising:

(a) 40–99.99 wt. % of a percarbonate salt;

(b) 0.01–20 wt. % of an ethylene oxide/propylene oxide block copolymer surfactant; and (c) 0–60 wt. % of a bicarbonate salt.

The percarbonate salts utilized in the formulations of the present invention may be selected from the sodium, calcium or potassium percarbonates.

The surfactants utilized in the present invention are ethylene oxide/propylene oxide block copolymers such as a compound of the formula:

$$HO(CH_2CH_2O)_x(CH_2-\underset{\underset{CH_3}{|}}{CHO})_y(CH_2CH_2O)_{x'}H$$

$$HO(CH_2\overset{\overset{CH_3}{|}}{C}HO)_x(CH_2CH_2O)_y(CH_2\overset{\overset{CH_3}{|}}{C}HO)_{x'}H$$

$$\begin{array}{l} H(OCH_2CH_2)_{y'}(O\overset{\overset{CH_3}{|}}{C}HCH_2)_{x'} \\ H(OCH_2CH_2)_{y''}(O\overset{\overset{CH_3}{|}}{C}HCH_2)_{x''} \end{array} \diagdown N-CH_2CH_2N \diagup \begin{array}{l} (CH_2\overset{\overset{CH_3}{|}}{C}HO)_{x'}(CH_2CH_2O)_{y'}H \\ (CH_2\overset{\overset{CH_3}{|}}{C}HO)_x(CH_2CH_2O)_yH \end{array}$$

wherein x, x', x'' and x''' are 2–122 and y, y', y'' and y''' are 2–32. PLURONIC ®F68, commercially available from BASF Corp. (Parsippany, N.J.) is an example of a block copolymer used in the invention.

The bicarbonate salts may be selected from sodium or potassium bicarbonate. Additionally, inactive fillers, or known cleaning or water softening additives may be added as necessary to produce the claimed cleaning formulation. For example, citric acid may be added to the cleaning formulation. The formulation may also contain appropriate enzymes. These include, but are not limited to, enzymes such as lipases and proteases.

Thus the present invention preferably comprises:

(a) a percarbonate salt selected from the group consisting of sodium, potassium, or calcium percarbonate;

(b) a nonionic surfactant selected from a compound of the formula:

$$HO(CH_2CH_2O)_x(CH_2-\underset{\underset{CH_3}{|}}{CHO})_y(CH_2CH_2O)_{x'}H$$

where x and x' are 2–122 and y is 16–54; or $$HO(CH_2\overset{CH_3}{\overset{|}{C}}HO)_x(CH_2CH_2O)_y(CH_2\overset{CH_3}{\overset{|}{C}}HO)_{x'}H$$

where x and x' are 7–21 and y is 4–163; or $$\begin{array}{l} H(OCH_2CH_2)_{y''}(O\overset{CH_3}{\overset{|}{C}}HCH_2)_{x''} \\ \qquad\qquad\qquad\qquad \diagdown \\ \qquad\qquad\qquad\qquad N-CH_2CH_2N \\ \qquad\qquad\qquad\qquad \diagup \\ H(OCH_2CH_2)_{y'''}(O\overset{CH_3}{\overset{|}{C}}HCH_2)_{x'''} \end{array} \qquad \begin{array}{l} (CH_2\overset{CH_3}{\overset{|}{C}}HO)_{x'}(CH_2CH_2O)_{y'}H \\ \qquad\qquad \diagdown \\ \qquad\qquad N \\ \qquad\qquad \diagup \\ (CH_2\overset{CH_3}{\overset{|}{C}}HO)_x(CH_2CH_2O)_yH \end{array}$$

wherein x, x', x'' and x''' are 2–122 and y,y', y'' and y''' are 2–32; and optionally (c) a bicarbonate salt selected from the group consisting of sodium or potassium bicarbonate.

More preferably, the cleansing formulation of the present invention comprises:

(a) sodium percarbonate;

(b) a nonionic surfactant selected from a compound of the formula:

$$HO(CH_2CH_2O)_x(CH_2-\underset{\underset{CH_3}{|}}{C}HO)_y(CH_2CH_2O)_{x'}H$$

where x=75, y=30 and x'=75; or $$HO(CH_2\overset{CH_3}{\overset{|}{C}}HO)_x(CH_2CH_2O)_y(CH_2\overset{CH_3}{\overset{|}{C}}HO)_{x'}H$$

where x=18, y=14, and x'=18; and (c) sodium bicarbonate;

and even more preferably:

(a) sodium percarbonate;

(b) a nonionic surfactant selected from a compound of $$HO(CH_2CH_2O)_x(CH_2-\underset{\underset{CH_3}{|}}{C}HO)_y(CH_2CH_2O)_{x'}H$$

where x=75, y=30 and x'=75; and (c) sodium bicarbonate.

Preferred weight amounts of percarbonate salt, ethylene oxide/propylene oxide block copolymer surfactant, and bicarbonate salt are:

(a) about 70–80 wt. % of a percarbonate salt;

(b) about 0.1–0.5 wt. % of an ethylene oxide/propylene oxide block copolymer surfactant; and (c) about 19.5–29.9 wt. % of a bicarbonate salt.

More preferred weight amounts of percarbonate salt, ethylene oxide/propylene oxide block copolymer surfactant, and bicarbonate salt are:

(a) about 74.7 wt. % of a percarbonate salt;

(b) about 0.3 wt. % of an ethylene oxide/propylene oxide block copolymer surfactant; and (c) about 25.0 wt. % of a bicarbonate salt.

Most preferred formulations of the invention are those having a preferred percarbonate salt, a preferred ethylene oxide/propylene oxide block copolymer surfactant, and a preferred bicarbonate salt, in amounts corresponding to preferred weight amounts.

A cleansing solution containing a formulation described above provides a surprisingly effective cleaner for pharmaceutical or cosmetic soils and achieves the targeted cleaning effect without utilizing organic solvents in the cleaning process. The formulations may be diluted with water to form a 1–10% strength cleansing solution. Preferably, the formulations are diluted with water to form a 4% aqueous solution.

The claimed composition therefore provides an environmentally safe alternative to the use of organic solvents since the byproducts are oxygen, water and carbonate salts. The cosmetic soils which can be cleaned or removed from cosmetic manufacturing equipment may be, but are not limited to, for example, lipstick, mascara and other typical cosmetic preparations. The pharmaceutical soils which may readily be removed using the claimed formulation include drugs, lotions and creams.

Preparation

The cleaning formulations claimed in the present application are readily prepared according to the following general procedure. Bicarbonate salt is added 16 a commercial. The blender is then turned on and a commercially available percarbonate salt is added while stirring. The quantity of the percarbonate added depends upon the desired target amount. The relative ratio of the percarbonate to the optional bicarbonate ranges from about 0.05 to about 9.0%. The nonionic surfactant is subsequently added to the stirring percarbonate or mixture of percarbonate and bicarbonate via a spray technique or formulation. The blend is then stirred for approximately 15 minutes at room temperature. The blend may then be dissolved in water and further diluted to a final concentration of about 1.0–10.0%. The formulation is preferably applied to the surface to be cleaned at a temperature range of 50°–75° C.

Stability Studies

Stability of hydrogen peroxide is enhanced when the claimed formulation is utilized. Stability of hydrogen peroxide in the formulation of the invention was measured at various temperatures over a one month period. A percarbonate control (100% percarbonate) was measured against present invention formulation "3031-60A" (containing 99.5 wt. % sodium percarbonate and 0.5 wt. % PLURONIC ®F68) and against present invention formulation "3031-27B" (containing 74.7 wt. % sodium percarbonate, 0.3 wt. % PLURONIC ®F68, and 25.0 wt. % sodium bicarbonate, at temperatures of 25° C., 40° C. and 50° C. At 25° C., the percentage of hydrogen peroxide lost for the control was 14 % while only 11% was lost for the two component mixture and 10% was lost for the three component mixture. At 40° C., the percentage of hydrogen peroxide lost for the control was 16% while only. 15% was lost for the two component mixture and 13% was lost for the three component mixture. At 50° C., the effect was more pronounced for the three component mixture versus the control and the two component mixture. At this temperature, the percent hydrogen peroxide lost for the control and the two component mixture was 26% while the percent hydrogen peroxide lost for the combination of percarbonate, surfactant and bicarbonate was 21%. These results clearly demonstrate that both the surfactant and the bicarbonate lend stability to the hydrogen peroxide and therefore more enhanced and longer duration cleansing ability for the claimed formulation. Surprisingly the cleaning ability is not due to only the oxidizing power of hydrogen peroxide but also to the bubbles generated in the bulk phase and especially at the metal/soil-liquid interface.

The soil removal properties of conventional cleaning formulations (CPD-0028, DPS-90003, CPD-1010, AK-7315, and AK-7315/HC-7645, all commercially available from Calgon-Vestal Laboratories, St. Louis, Mo.), were evaluated under appropriate conditions, and compared with the percarbonate based formulations of the present invention described above, 3031–27B and 3031–60A. The results show that percarbonate based products of the present invention readily remove a variety of cosmetic or pharmaceutical soils at temperatures ranging from about 500° C. to about 75° C. and are superior to non-percarbonate based conventional formulations.

The conventional cleaning formulations and examples of formulations of the present invention are described below.

| Conventional Product | Composition |
|---|---|
| CPD-0028* | Highly alkaline product based on NaOH. |
| DPS-90003* | Alkaline product based on NaOCl. |
| CPD-1010* | Highly alkaline product containing surfactants and organic solvents. |
| AK-7315* | Highly alkaline product based on NaOH and surfactants. |
| AK-7315 and HC-7645* | Mild alkalinity product based on NaOH and high concentrations of surfactants and organic solvents. |

*commercially available from Calgon-Vestal Laboratories (St. Louis, MO)

| Percarbonate based | Composition |
|---|---|
| 3031-27B | 74.7 wt. % sodium percarbonate, 0.3 wt. % PLURONIC ® F68, and 25.0 wt. % sodium bicarbonate |
| 3031-60A | 99.5 wt. % sodium percarbonate and 0.5 wt. % PLURONIC ® F68 |

The following examples show various applications of the claimed formulations, describe or show the processes for making the claimed formulations, and demonstrate superior cleansing properties of formulations of the invention compared with conventional products. One of ordinary skill in the art will readily recognize that the claimed formulation is not limited to the examples shown below but has applicability to a wide range of cleaning utilities or purposes and may be applied generally throughout the pharmaceutical and cosmetic arts.

EXAMPLES

EXAMPLE 1

Preparation of a Peroxide Based Cleansing Formulation

Twenty-five(25) grams of sodium bicarbonate was added to a blender. Sodium percarbonate(74.7 grams) was added to the stirring blender and 0.3 grams PLURONIC ®F68 was sprayed into the batch. The blend was stirred for approximately fifteen minutes. The identical process is followed to prepare the percarbonate and surfactant preparation without the initial addition of a bicarbonate. The batch was then diluted in an aqueous solution to a 4% solution for testing.

EXAMPLE 2

Cleaning Power of the Percarbonate Based Formulations

Stainless steel panels (3"×5") were coated with a thin film of a given soil such as lipstick on a single side only. These panels were then immersed in a 2 liter beaker containing 4% of the formulated product based on percarbonate. The panels were removed from the cleaning solution after a predetermined period of exposure, typically 0.5–1.0 hr. After removal the panels were rinsed with tap water and the percent cleaning determined based on the percent of the soiled surface cleaned by visual inspection. An evaluation was also carried out by a weight loss method in which the soiled panel was weighed both before and after the cleaning. Results of particular tests are described in Tables 1–4.

Tables 1 and 2 demonstrate the effectiveness of the claimed compositions 3031-27B(25.0 wt. % sodium bicarbonate, 74.7 wt. % sodium percarbonate and 0.3 wt. % PLURONIC ®F68) and 3031-60A(99.5 wt. % sodium percarbonate and 0.5 wt. % PLURONIC ®F68) in cleaning a cosmetic soil, MAYBELLINE TM lipstick red (MLR-7), from stainless steel panels after a one hour exposure. Product tested, temperature and concentrations conditions are indicated. The claimed formulation did not require agitation to effectively remove the soil.

TABLE 1

| Product | Lipstick Removal Temp/°C. | Concentration | wt. %-clean |
|---|---|---|---|
| CPD-0028 | 71 | 35 ml/1000 ml | 11.7 |
| 3031-27B | 71 | 35 g/1000 ml | 83.1 |
| 3031-27B | 71 | 35 g/1000 ml | 101.6 |
| DPS-90003 | 71 | 35 ml/1000 ml | 9.6 |
| CPD-1010 | 71 | 35 ml/1000 ml | 12.6 |
| AK-7315 | 71 | 35 ml/1000 ml | 2.0 |
| AK-7315 HC-7645 | 71 | 35 ml/1000 ml | 5.0 |
| AK-7315 HC-7645 | 71 | 40 ml/1000 ml | 5.0 |
| 3031-60A | 55 | 40 g/1000 ml | 85.0 |
| 3031-60A | 55 | 40 g/1000 ml | 95.0 |
| 3031-60A | 55 | 40 g/1000 ml | 100.0 |
| AK-7315 HC-7645 | 71 | 40 ml/1000 ml | 55.0 |
| AK-7315 HC-7645 | 71 | 40 ml/1000 ml | 15.0 |

As indicated in Table 1, the claimed formulation has significantly improved cleaning properties versus the other described products. Generally, a 1–10% solution of the formulation in water may be used to clean or remove the pharmaceutical or cosmetic soils from the processing equipment. Advantageously, a 4% solution is used at a temperature range of 50°–75° C. Table 2 further demonstrates the effectiveness of the claimed formulation in cleaning cosmetic soils such as MLR-7.

TABLE 2

| Product (4% solution) | Temp. °C. | Lipstick Removal % cleaning by weight loss | % cleaning by visual inspection | Water break free |
|---|---|---|---|---|
| 3031-60A | 55 | 87.1 | >85% | yes |

TABLE 2-continued

| Product (4% solution) | Temp. °C. | Lipstick Removal: % cleaning by weight loss | % cleaning by visual inspection | Water break free |
|---|---|---|---|---|
| 3031-60A | 55 | 100.00 | 100% | yes |
| 3031-60A | 55 | 97.1 | >95% | yes |
| 3031-27B | 55 | 97.1 | >95% | yes |
| 3031-27B | 55 | 95.7 | >95% | yes |
| 3031-27B | 55 | 99.3 | >95% | yes |
| AK-7315 | 55 | 36.4 | | |
| HC-7645 | | | | |
| AK-7315 | 55 | 27.9 | | |
| HC-7645 | | | | |
| AK-7315 | 55 | 47.9 | | |
| HC-7645 | | | | |
| 3031-60A | 71 | 99.3 | >95% | yes |
| 3031-60A | 71 | 96.4 | >95% | yes |
| 3031-60A | 71 | 97.8 | >95% | yes |
| 3031-27B | 71 | 99.3 | >95% | yes |
| 3031-27B | 71 | 99.5 | >95% | yes |
| AK-7315 | 71 | 57.1 | | |
| HC-7645 | | | | |
| AK-7315 | 71 | 38.6 | | |
| HC-7645 | | | | |
| AK-7315 | 71 | 45.7 | | |
| HC-7645 | | | | |

Tables 3 and 4 readily demonstrate the effectiveness of the claimed formulation in cleaning pharmaceutical soils such as drugs or lotions. The particular pharmaceutical compound used in Table 3 is Simvastatin while the lotion used in Table 4 is honey/almond lotion. In Tables 3 and 4 the time of exposure is one hour.

TABLE 3

| Product | Simvastatin Removal: Temp. (°C.) | Concentration | wt. %-clean |
|---|---|---|---|
| 3031-33D | 60 | 32.1 g/1000 ml | 96 |
| CPD-0028 | 60 | 32.1 g/1000 ml | 100 |
| CPD-1010 | 60 | 32.1 g/1000 ml | 98 |
| HC-7645 | 60 | 32.1 g/1000 ml | 95 |
| AK-7315 | 60 | 32.1 g/1000 ml | 96 |
| 3031-27B | 60 | 32.1 g/1000 ml | 80–90 |
| HC-7645 | 60 | 32.1 g/1000 ml | 95 |
| AK-7315 | | | |
| AK-7315 | 60 | 32.1 g/1000 ml | 96, |
| | 95–100* | | |
| 3031-60A | 60 | 32.1 g/1000 ml | 100, |
| | | | 95–100* |
| HC-7645 | 60 | 32.1 g/1000 ml | 80, |
| | | | 75–80* |
| HC-7645 | 60 | 32.1 g/1000 ml | 96 |

* = visual assessment.

As shown above in Table 3, the claimed formulation is effective in removing drugs from equipment after the manufacturing process is complete and achieves cleaning without the use of organic solvents. Table 4 below further shows effective removal of a pharmaceutical soil selected from, for example, honey/almond lotion (HAL) at 60° C. after a one hour exposure.

TABLE 4

| Product | Honey/Almond Lotion: Temp.(°C.) | Concentration | wt. %-clean |
|---|---|---|---|
| 3031-33D | 60 | 32.1 g/1000 ml | 97 |
| CPD-0028 | 60 | 32.1 g/1000 ml | 100 |

TABLE 4-continued

| Product | Honey/Almond Lotion: Temp.(°C.) | Concentration | wt. %-clean |
|---|---|---|---|
| CPD-1010 | 60 | 32.1 g/1000 ml | 95–100 |
| HC-7645 | 60 | 32.1 g/1000 ml | 95–100 |
| AK-7315 | 60 | 32.1 g/1000 ml | 99 |
| 3031-27B | 60 | 32.1 g/1000 ml | 97 |
| HC-7645 | 60 | 32.1 g/1000 ml | 95 |
| AK-7315 | | | |
| AK-7315 | 60 | 32.1 g/1000 ml | 50, |
| | | | >90* |
| 3031-60A | 60 | 32.1 g/1000 ml | 67, |
| | | | 95 > 100* |
| HC-7645 | 60 | 32.1 g/1000 ml | 27, |
| | | | 30* |

* = visual assessment

The foregoing examples demonstrate the broad applicability of the present invention, i.e. a cleaning formulation and a process for removing hard-to-remove cosmetic or phamaceutical soils. The present invention's application is therefore not limited to removal of the particular phamaceutical or cosmetic soils described in the Tables but may also be applied to any cosmetic or pharmaceutical soil. Thus the invention has wide applicability in the pharmaceutical and cosmetic industry and provides significant benefit since effective cleaning power or removal is achieved without the use of organic solvent pollutants.

While advantageously the formulations are used to clean manufacturing surfaces which acquire cakes of pharmaceutical or cosmetic soils, the formulation has general applicability on a variety of surfaces in need of treatment thereof where it is necessary to remove hard-to-remove pharmaceutical or cosmetic soils. For example, the formulation may be utilized in rinsing containers or bottles containing pharmaceuticals or cosmetics in order to effectively clean a bottle or vessel.

What is claimed is:

1. A cleansing formulation free of organic solvents comprising:

(a) 40–99.99 weight percent of a percarbonate salt;

(b) 0.01–20 weight percent of an ethylene oxide/propylene oxide block copolymer surfactant; and (c) 0–60 weight percent of a bicarbonate salt.

2. The cleansing formulation of claim 1 wherein:

(a) the percarbonate salt is selected from the group consisting of sodium, potassium, or calcium percarbonate;

(b) the ethylene oxide/propylene oxide block copolymer surfactant is selected from a compound of the formula:

$$HO(CH_2CH_2O)_x(CH_2-\underset{\underset{CH_3}{|}}{CHO})_y(CH_2CH_2O)_{x'}H$$

where x and x' are 2–122 and y is 16–54; or $$HO(CH_2\overset{\overset{CH_3}{|}}{C}HO)_x(CH_2CH_2O)_y(CH_2\overset{\overset{CH_3}{|}}{C}HO)_{x'}H$$

where x and x' are 7–21 and y is 4–163; or

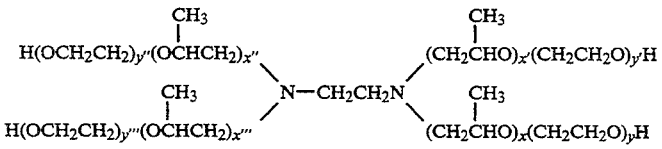

wherein x, x', x'' and x''' are 2–122 and y,y', y'' and y''' are 2–32; and (c) the bicarbonate salt is selected from the group consisting of sodium or potassium bicarbonate.

3. The cleansing formulation of claim 2 wherein:

(a) the percarbonate is sodium percarbonate;

(b) the ethylene oxide/propylene oxide block copolymer surfactant is selected from a compound of the formula:

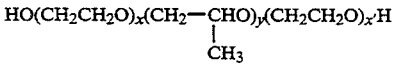

where x=75, y=30 and x'=75; or

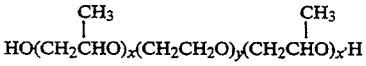

where x=18, y=14 and x'=18; and (c) the bicarbonate is sodium bicarbonate.

4. The cleansing formulation of claim 3, wherein:

(a) the percarbonate is sodium percarbonate;

(b) the ethylene oxide/propylene oxide block copolymer surfactant is selected from a compound of the formula:

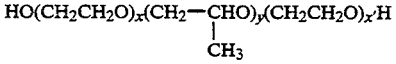

where x=75, y=30 and x'=75; and (c) the bicarbonate is sodium bicarbonate.

5. The cleansing formulation of claim 1 wherein the weight amounts of percarbonate salt, ethylene oxide/propylene oxide block copolymer surfactant, and bicarbonate salt are:

(a) about 70-80 wt. % of a percarbonate salt;

(b) about 0.1–0.5 wt. % of an ethylene oxide/propylene oxide block copolymer surfactant; and (c) about 19.5–29.9 wt. % of a bicarbonate salt.

6. The cleansing formulation of claim 2 wherein the weight amounts of percarbonate salt, ethylene oxide/propylene oxide block copolymer surfactant, and bicarbonate salt are:

(a) about 70–80 wt. % of a percarbonate salt;

(b) about 0.1–0.5 wt. % of an ethylene oxide/propylene oxide block copolymer surfactant; and (c) about 19.5–29.9 wt. % of a bicarbonate salt.

7. The cleansing formulation of claim 3 wherein the weight amounts of percarbonate salt, ethylene oxide/propylene oxide block copolymer surfactant, and bicarbonate salt are:

(a) about 70–80 wt. % of a percarbonate salt;

(b) about 0.1–0.5 wt. % of an ethylene oxide/propylene oxide block copolymer surfactant; and (c) about 19.5–29.9 wt. % of a bicarbonate salt.

8. The cleansing formulation of claim 4 wherein the weight amounts of percarbonate salt, ethylene oxide/propylene oxide block copolymer surfactant, and bicarbonate salt are:

(a) about 70–80 wt. % of a percarbonate salt;

(b) about 0.1–0.5 wt. % of an ethylene oxide/propylene oxide block copolymer surfactant; and (c) about 19.5–29.9 wt. % of a bicarbonate salt.

9. The cleansing formulation of claim 5, wherein the percarbonate is about 74.7 weight percent, the ethylene oxide/propylene oxide block copolymer surfactant is about 0.3 weight percent and the bicarbonate is about 25.0 weight percent.

10. The cleansing formulation of claim 6, wherein the percarbonate is about 74.7 weight percent, the ethylene oxide/propylene oxide block copolymer surfactant is about 0.3 weight percent and the bicarbonate is about 25.0 weight percent.

11. The cleansing formulation of claim 7, wherein the percarbonate is about 74.7 weight percent, the ethylene oxide/propylene oxide block copolymer surfactant is about 0.3 weight percent and the bicarbonate is about 25.0 weight percent.

12. The cleansing formulation of claim 8, wherein the percarbonate is about 74.7 weight percent, the ethylene oxide/propylene oxide block copolymer surfactant is about 0.3 weight percent and the bicarbonate is about 25.0 weight percent.

13. A cleansing solution comprising the cleansing formulation of claim 1 and a diluent.

14. A cleansing solution comprising the cleansing formulation of claim 2 and a diluent.

15. A cleansing solution comprising the cleansing formulation of claim 3 and a diluent.

16. A cleansing solution comprising the cleansing formulation of claim 4 and a diluent.

17. The cleansing solution of claim 13 wherein the cleaning formulation is 1–10 weight percent of the total weight of the solution.

18. The cleansing solution of claim 14 wherein the cleaning formulation is 1–10 weight percent of the total weight of the solution.

19. The cleansing solution of claim 15 wherein the cleaning formulation is 1–10 weight percent of the total weight of the solution.

20. The cleansing solution of claim 16 wherein the cleaning formulation is 1–10 weight percent of the total weight of the solution.

21. The cleansing solution of claim 17 wherein the cleansing formulation is about 4 weight percent of the total weight of the solution.

22. The cleansing solution of claim 18 wherein the cleansing formulation is about 4 weight percent of the total weight of the solution.

23. The cleansing solution of claim 19 wherein the cleansing formulation is about 4 weight percent of the total weight of the solution.

24. The cleansing solution of claim 20 wherein the cleansing formulation is about 4 weight percent of the total weight of the solution.

25. A method of removing pharmaceutical and cosmetic soils, comprising administering to a surface in need of treatment thereof the cleaning formulation of claim 1.

26. A method of removing pharmaceutical and cosmetic soils, comprising administering to a surface in need of treatment thereof the cleaning formulation of claim 2.

27. A method of removing pharmaceutical and cosmetic soils, comprising administering to a surface in need of treatment thereof the cleaning formulation of claim 3.

28. A method of removing pharmaceutical and cosmetic soils, comprising administering to a surface in need of treatment thereof the cleaning formulation of claim 4.

* * * * *